United States Patent [19]

Larson et al.

[11] 3,948,352

[45] Apr. 6, 1976

[54] EXTENSION LADDER WITH LADDER LEVELER MEANS

[75] Inventors: Clayton E. Larson, Brooklyn, N.Y.; Edwin H. Lemp, Bellows Falls, Vt.

[73] Assignee: White Metal Rolling & Stamping Corporation, Brooklyn, N.Y.

[22] Filed: July 15, 1975

[21] Appl. No.: 596,005

[52] U.S. Cl. ..... 182/204; 182/207

[51] Int. Cl.[2] ..... E06C 7/44

[58] Field of Search ..... 182/204, 205, 201, 202, 182/108, 107, 209, 207; 248/188.2, 188.8, 188.1

[56] References Cited

UNITED STATES PATENTS

| | | | |
|---|---|---|---|
| 2,936,849 | 5/1960 | Larson | 182/204 |
| 3,027,968 | 4/1962 | Ouellette | 182/201 |
| 3,414,082 | 12/1968 | Gilland | 182/204 |

*Primary Examiner*—Reinaldo P. Machado
*Attorney, Agent, or Firm*—Kemon, Palmer & Estabrook

[57] ABSTRACT

A extension ladder formed of interlocked top and bottom sections has ladder leveler means comprising a pair of sleeve members that slideably encompass the lower end of the bottom section siderails. A short flange on each sleeve member is captivated by a guide member carried on the inside of each lower siderail permitting the sleeve members to be securely retained in operative position on the bottom of the ladder without interference with the free sliding of the ladder top section along the bottom section.

8 Claims, 6 Drawing Figures

FIG. 1
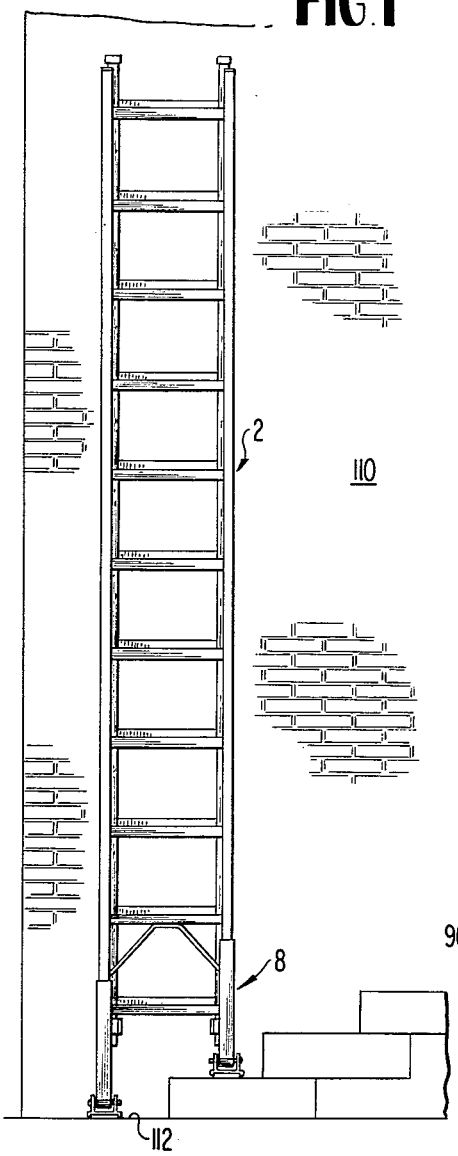
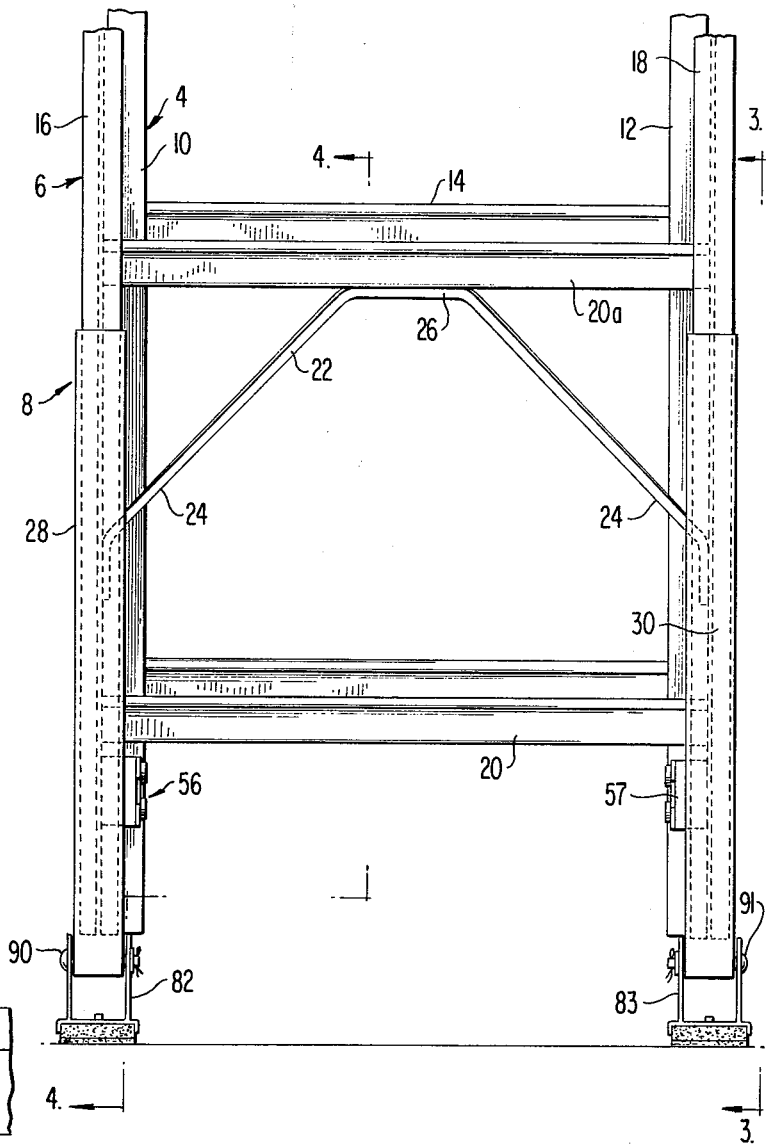
FIG. 2
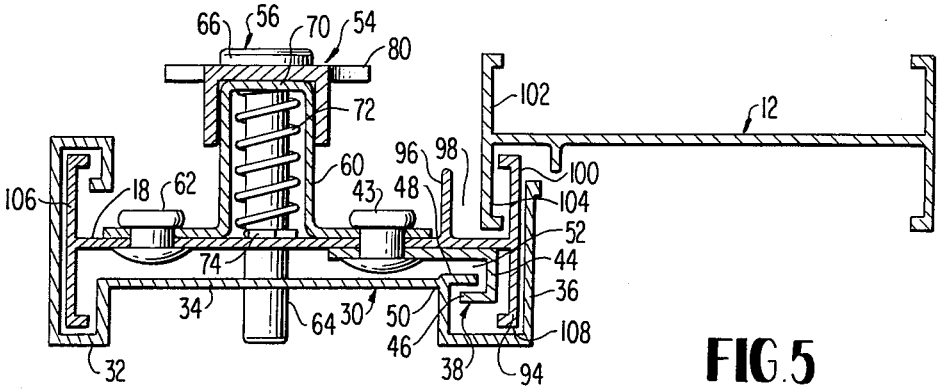
FIG. 5

EXTENSION LADDER WITH LADDER LEVELER MEANS

BACKGROUND OF THE INVENTION

1. Field of the Invention

This invention relates to extension ladders and particularly to those having leveler means that enable the ladders to be positioned upright or uneven or inclined surfaces.

2. Description of the Prior Art

Extension ladders that have a top section which slides relative to a bottom section for height adjustment are well known. Early ladders of this type were generally made of wood and the sections were held together by collar or angle iron units. More recently, extension ladders have been formed of metal, e.g., extruded aluminum or magnesium, and have siderails made with channel sections that provide interlocking engagement between the top and bottom ladder sections. Such interlock arrangement usually extends the entire length of the ladder and imposes limitations on attachments or appendages that may be applied to such ladders.

Extension ladders must frequently be used at locations that do not provide a level surface for support of the ladder. Hence, leveler means to permit upright positioning of the ladder on unlevel support surfaces have been developed. Such levelers have included slotted foot units (see U.S. Pat. No. 1,491,642), pin adjustable, slideable sleeves (see U.S. Pat. No. 809,057), cam-locking channel members (see U.S. Pat. No. 1,718,891) and pin adjustable channel extenders (see U.S. Pat. No. 1,246,709). Such prior known levelers, however, are not suitable for use with extruded metal ladders of the section interlocking type because they prevent free sliding of the top and bottom ladder sections.

Some forms of levelers have been applied to the interlocked-type metal ladders, but there exists a need for leveler means for this type of ladder that may be produced at low cost, will be fault-free and provide secure operation meeting OSHA requirements and do not interfer with the free sliding of the sections of the extension ladder.

OBJECTS

A principle object of the present invention is the provision of extension ladders of the top and bottom interlocked section type equipped with ladder leveler means that will enable the ladder to be positioned upright on uneven or inclined surfaces.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects of the invention are accomplished by improved ladder leveler means for extension ladders that have a bottom section and a top section each formed of a pair of spaced-apart siderails supporting a plurality of rungs wherein said sections are inter-locked by slideable engagement of the siderails of the top section with flanges at the rear of the sidewalls of the bottom section. Such ladder-leveler means comprises:

A. a pair of sleeve members each formed of metal comprising
   - a G-shaped front portion,
   - a central web portion, and
   - a J-shaped rear portion, said portions being integral providing a channel form unit, B. one of said sleeve members slideably encompassing one of the siderails of said bottom section and the other sleeve member slideably encompassing the opposite bottom section siderail, C. a J-shaped guide member fixed upon each bottom section siderail at the outside rear thereof near the bottom end of the siderail, each said guide member comprising
   - a leg by which the guide member is fixed to its respective siderail, a transverse web and
   - a lip extending from the end of the transverse web parallel to said leg, D. a flange extending from the junction of said rear portion with said web portion of each said sleeve member into the gap between said leg and lip of said guide member whereby the rear of each sleeve member is retained by the respective guide member in slideable engagement with the respective siderail, E. a plurality of spaced-apart, longitudinally aligned holes extending transversely through the central web portion of each sleeve member, and F. spring-biased pin means carried by each lower portion siderail to extend through holes in the respective sleeve members and hold the sleeve members at selected positions along the lower portion siderails.

In a preferred embodiment of extension ladders of the invention, each of the sleeve members of the leveler means has a padded foot pivoted upon its lower end. Further additional features may be included in the new ladders as will appear from the more detailed description which follows.

BRIEF DESCRIPTION OF THE DRAWINGS

A more complete understanding of the new ladder structures of the invention may be obtained by reference to the accompanying drawings in which:

FIG. 1 is a front elevational view of an extension ladder of the invention supported upon an uneven surface, but in an upright position.

FIG. 2 is a fragmentary front elevational view of the bottom part of the extension ladder.

FIG. 5 is an enlarged top sectional view taken along the line 5—5 of FIG. 3.

DESCRIPTION OF PREFERRED EMBODIMENTS

Figure 3:
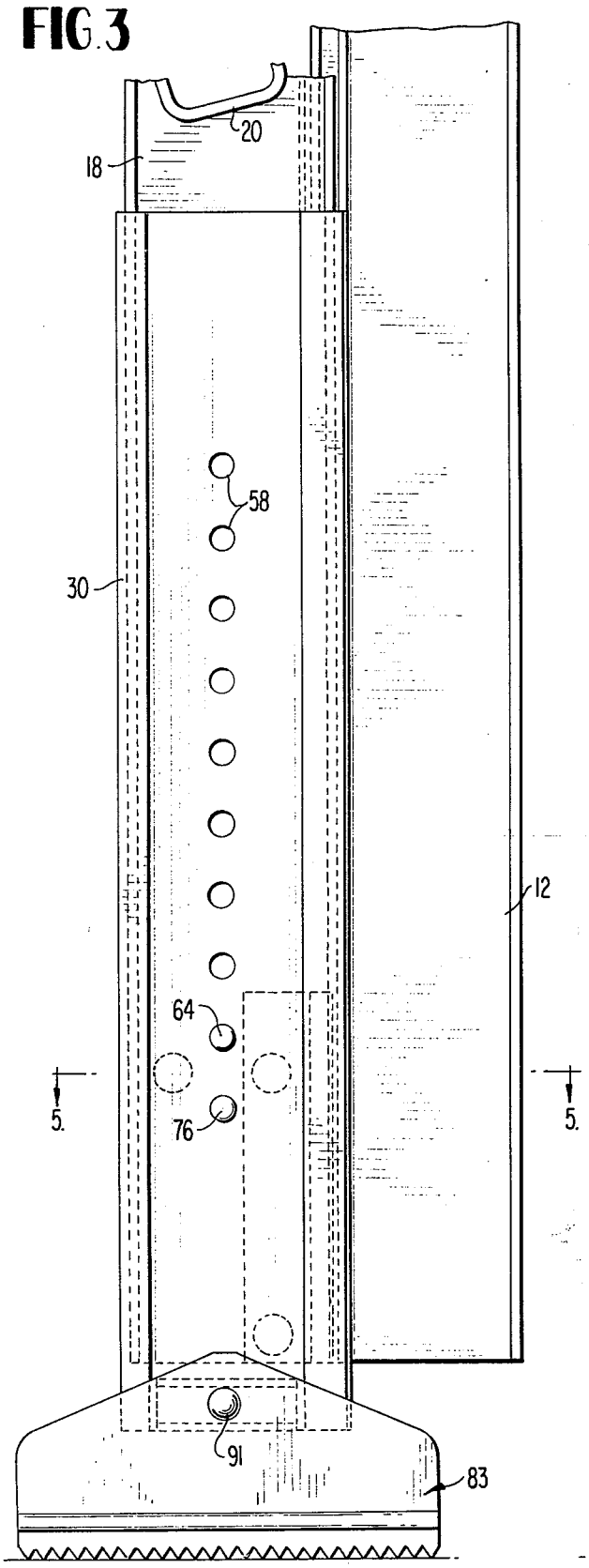
FIG. 3 is a fragmentary side view of the ladder view taken along the line 3—3 of FIG. 2.

Referring in detail to the drawings, the extension ladder 2 comprises top section 4, bottom section 6 and ladder leveler means 8.

The top section 4 has left and right siderails 10 and 12, respectively, that support a plurality of rungs 14. Similarly, bottom section 6 has left and right siderails 16 and 18 supporting rungs 20. A brace 22 is riveted at its ends 24 to siderails 16 and 18 and at the center 26 to the rung 20*a* of the bottom section 6.

The top section 4 and bottom section 6 are interlocked through slideable engagement in a manner to be described in detail below.

The ladder leveler means 8 comprises a left sleeve member 28 and a mirrow-image right sleeve member 30. The sleeve members are preferably formed of extruded metal, e.g., aluminum, with a G-shaped front portion 32, a central web portion 34, and a J-shaped rear portion 36. These portions as can be seen in FIG. 5, are integral and provide a channel form unit that encompasses the corresponding siderail 18.

Figure 6:
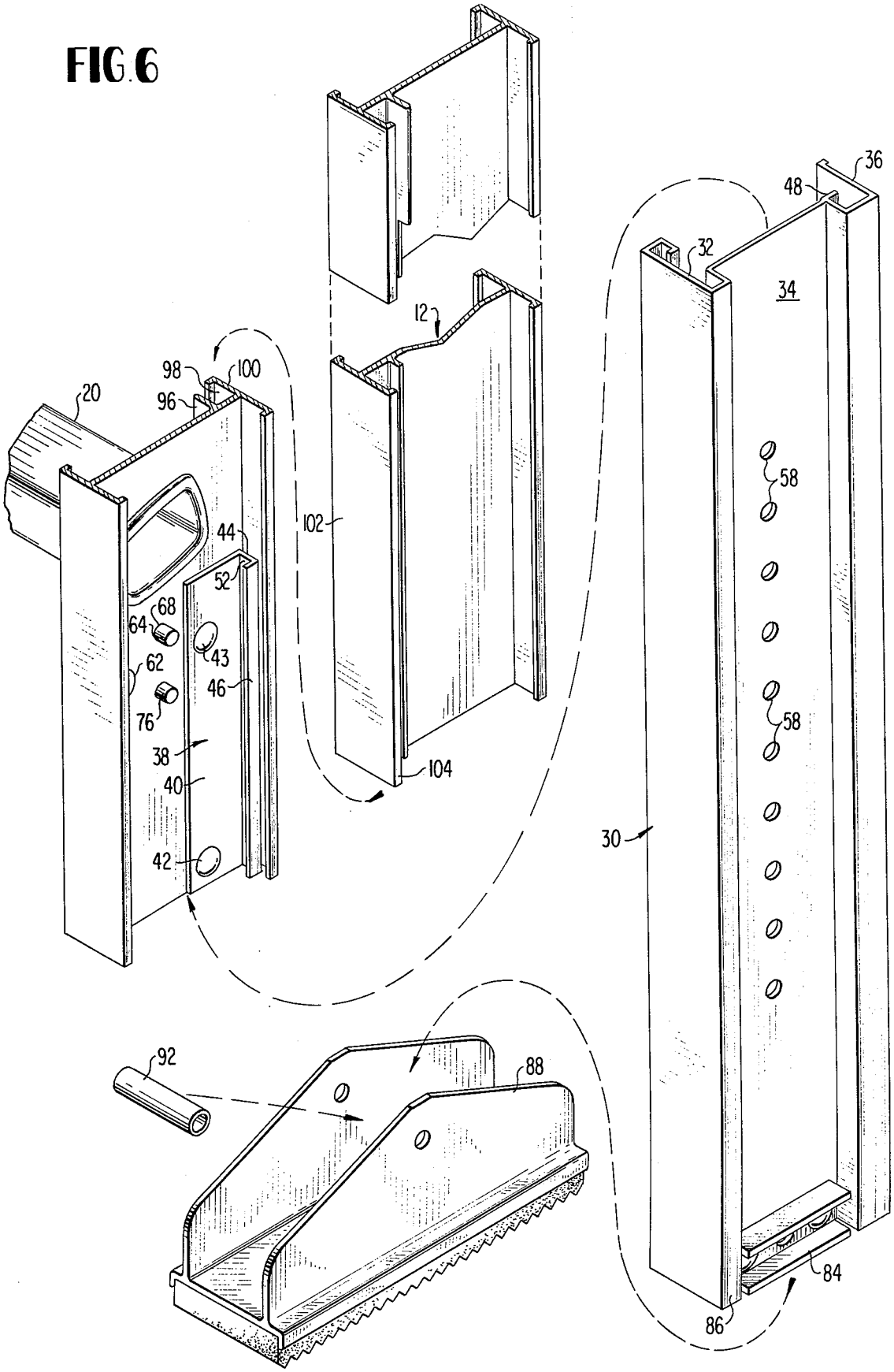
FIG. 6 is a exploded fragmentary view, partly in section, showing details of the new ladder leveler means.

The ladder leveler means 8 also comprises a pair of J-shaped guide members 38, one being fixed (see FIG. 5) upon the bottom section siderail 18 at the outside rear thereof near the bottom end of the side-rail (see FIGS. 3 and 6). The other guide member of the pair 38 is similarly fixed to siderail 16 (not shown in detail). Each guide member has a leg 40, by which it is fastened through rivets 42 and 43 to its respective siderail, a transverse web 44 and a lip 46 extending from the end of the transverse web 44.

The guide members 38 serve to retain sleeve members 28 and 30 respectively in working, slideable engagement with the corresponding siderails 16 and 18. For this purpose, each sleeve member has a flange 48 that projects from the junction 50 of the J-shaped rear portion 36 with the web portion 34 of the sleeve member 30. This flange 48 extends into the gap 52 between the leg 40 and lip 46 of the guide member 38.

The ladder leveler means 8 also has position selector means 54 comprising pin means 56 and 57 and a plurality of spaced-apart, longitudinally aligned holes 58 that extend transversely through the web portion 34 of the sleeve members.

Figure 4:
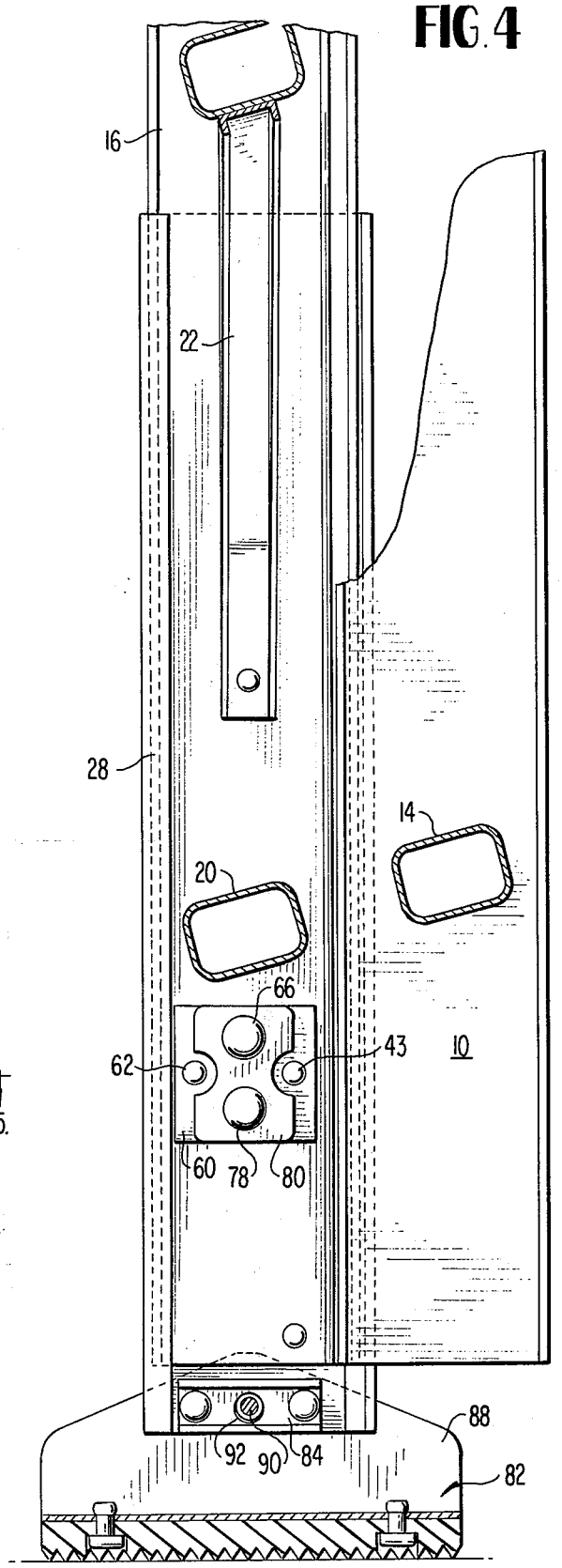
FIG. 4 is a fragmentary side sectional view taken along the line 4—4 of FIG. 2.

Pin means 56 is carried by bottom siderail 16 and pin means 57 by bottom siderail 18. They are constructed alike as seen in FIGS. 4 and 5. Each pin means comprises a U-shaped member 60 fixed to the respective siderail 18 by rivets 43 and 62. A pin 64 having head 66 extends through a hole 68 in the side-rail 18 and hole (not numbered) in the base 70 of U-shaped member 60. A coil spring 72 is captured between the base 70 and a cotter pin 74 that extends through the pin 64. A second headed pin 76 with head 78 (see FIG. 4) is spring-biased in U-shaped member 60. A pin-puller 80 is carried by the pins 60 and 76 between the base 70 and the pin heads 66 and 78 to permit both pins to be pulled together out of engagement with the sleeve member holes 58 in moving the sleeve members to selected positions along the lower portion siderails. The twin-pin arrangement as described is provided for safety purposes. Less expensive construction using only a single spring-biased pin 64 could be used in jurisdictions where safety regulations permit.

Padded feet 82 and 83 are pivoted upon the lower ends of sleeve members 28 and 30 respectively. Each sleeve member has a pair of channel braces 84 riveted at the bottom end 86. The padded feet have flanges 88 spaced apart slightly greater than the width of the sleeve member 30. Cottered pivot pins 90 and 91 extend through holes in the sleeve members and corresponding braces 84 to hold the feet 82 and 83 on the sleeve members 28 and 30 respectively. Tube sections 92 surround the pins 90 or 91 between the foot flanges 88 to hold the flanges apart against bending stresses that may occur in the use of the ladder.

The interlocked engagement of the top portion 4 and bottom portion 6 is apparent in FIG. 5. Lower portion siderail 18 has a T-shaped rear portion 94 and an integral flange 96 that extends inwardly of the siderail forming a U-shaped channel 98 between the flange 96 and the inside end 100 of the T-shaped portion 94 of the siderail 18. The top portion siderail 12 has a T-shaped front portion 102 the outboard lip 104 of which is slideably carried in the U-shaped channel 98. A comparable structure is provided for siderails 10 and 16. Such arrangement provides the slideable interlock between top section 4 and bottom section 6. However, other equivalent interlock structures for metal ladders are known and could be used with the ladder leveler means herein described.

The structure of guide means 38 that serves to hold sleeve members 28 and 30 on the ladders has been described above. Such means could be employed with a variety of siderail and sleeve member cross-sections. In the preferred embodiment shown in FIG. 5, the lower portion siderail 18 has a T-shaped front end 106 that is substantially encircled by the G-shaped front portion 32 of sleeve member 30. Also the siderail 30 has T-shaped rear end 94 encompassed at its outer edge 108 and a part only of the backside by said J-shaped rear portion 36 of the sleeve member 30. Hence, there is no interference between the top section 4 and the sleeve members 28 and 30 regardless of the positioning of the top section 4 relative to the bottom section 6 in use of the ladder.

FIG. 1 shows the ladder 2 in upright position against the brick wall 110 although the supporting surface for the ladder is uneven. The ladder is shown in FIG. 1 in its completely closed condition. The ladder can be held in various selected extended positions by pivoted hook beans (not shown) or any other equivalent units known in the ladder art. Further, the ladder could involve further brace members in addition to illustrated brace 22 if desired for added strengthening. Also, the new extension ladders can be made with three or more interlocked extension sections rather than the two sections as shown and described.

The embodiments of the invention in which an exclusive property or privilege is claimed are defined as follows:

1. In an extension ladder having a bottom section and a top section wherein said sections are each formed of left and right spaced-apart siderails supporting a plurality of rungs there between and said sections are interlocked by slideable engagement of the siderails of the top section with flanges at the rear of the siderails of the bottom section, the improvement which consists of ladder leveler means to enable the ladder to be positioned upright or uneven or inclined surfaces which comprises:

A. a pair of sleeve members each formed of metal comprising
   a G-shaped front portion,
   a central web portion, and
   a J-shaped rear portion, said portions being integral providing a channel form unit, B. one of said sleeve members slideably encompassing one of the siderails of said bottom section and the other sleeve member slideably encompassing the opposite bottom section siderail, C. a J-shaped guide member fixed upon each bottom section siderail at the outside rear thereof near the bottom end of the siderail, each said guide member comprising a leg by which the guide member is fixed to its respective siderail, a transverse web and a lip extending from the end of the transverse web parallel to said leg, D. a flange extending from the junction of said rear portion with said web portion of each said sleeve member into the gap between said leg and lip of said guide member whereby the rear of each sleeve member is retained by the respective guide member in slideable engagement with the respective siderail, E. a plurality of spaced-apart, longitudinally aligned holes extending transversely through the central web portion of each sleeve member, and F. spring-biased pin means carried by each lower portion siderail to extend through holes in the respective sleeve members and hold the sleeve members at selected positions along the lower portion siderails.

2. The ladder of claim 1 wherein each lower portion siderail has a T-shaped front end that is substantially encircled by said G-shaped front portion of a sleeve member.

3. The ladder of claim 2 wherein each lower portion siderail has a T-shaped rear end which is encompassed at the outer edge and a part only of the backside by said J-shaped rear portion of a sleeve member.

4. The ladder of claim 3 wherein each lower portion siderail comprises an integral flange that extends inwardly of the siderail forming a U-shaped channel at the inside rear thereof.

5. The ladder of claim 4 wherein each top portion siderail has a T-shaped front portion one lip of which is slideably carried in said U-shaped channel.

6. The ladder of claim 1 wherein the lower end of each sleeve member has pivoted thereon a padded foot.

7. The ladder of claim 1 wherein said pin means comprises a U-shaped member fixed to the inside of its respective siderail, a headed pin extending through aligned holes in said siderail and the base of the U-shaped member and a coil spring captured between said base and a cotter pin extending through said headed pin.

8. The ladder of claim 7 wherein each pin means comprises a pair of said headed pins and captured coil spring.

* * * * *